US007201818B2

(12) United States Patent
Eastman, II

(10) Patent No.: US 7,201,818 B2
(45) Date of Patent: Apr. 10, 2007

(54) METHOD OF MAKING ARROW SHAFT INCLUDING INTEGRAL SLEEVE, AND ARROW SHAFT WHICH IS PRODUCED THEREBY

(75) Inventor: Robert Eastman, II, Flint, MI (US)

(73) Assignee: Eastman Holding Company, Flushing, MI (US)

( * ) Notice: Subject to any disclaimer, the term of this patent is extended or adjusted under 35 U.S.C. 154(b) by 0 days.

(21) Appl. No.: 10/701,896

(22) Filed: Nov. 5, 2003

(65) Prior Publication Data

US 2004/0089404 A1 May 13, 2004

Related U.S. Application Data

(63) Continuation of application No. 10/341,635, filed on Jan. 14, 2003, now Pat. No. 6,866,599, which is a continuation of application No. 09/685,233, filed on Oct. 10, 2000, now Pat. No. 6,520,876.

(51) Int. Cl.
*B32B 37/00* (2006.01)

(52) U.S. Cl. ..... 156/187; 156/153; 156/172; 156/188; 156/191

(58) Field of Classification Search ..... 156/187, 156/188, 166, 172, 191, 153; 473/578; 273/DIG. 7
See application file for complete search history.

(56) References Cited

U.S. PATENT DOCUMENTS 2,535,033 A * 12/1950 Bergere ..... 473/120
2,694,661 A 11/1954 Meyer
2,747,876 A * 5/1956 Teller ..... 473/585
2,816,595 A * 12/1957 Hudak ..... 273/DIG. 7
3,129,003 A * 4/1964 Mueller et al. ..... 473/568
3,353,826 A * 11/1967 Traverse ..... 473/561
3,770,556 A 11/1973 Evans et al.
3,865,374 A 2/1975 Troncoso, Jr.
3,915,783 A * 10/1975 Goppel et al. ..... 156/245
4,148,482 A * 4/1979 Harwell et al. ..... 473/561
4,234,190 A * 11/1980 Airhart ..... 473/585
4,268,038 A 5/1981 Wierenga
4,489,949 A 12/1984 Taylor et al.
4,533,146 A 8/1985 Schaar
4,534,568 A 8/1985 Tone
4,706,965 A 11/1987 Schaar (Continued)

*Primary Examiner*—Jeff H. Aftergut
(74) *Attorney, Agent, or Firm*—Carrier, Blackman & Associates, P.C.; William D. Blackman; Joseph P. Carrier

(57) ABSTRACT

In a method of making an arrow shaft, a fabric section is placed around a hollow tubular core, and is affixed thereto. The core may include carbon therein. An adhesive or protective composition, associated with the fabric, is cured to adhere the fabric to the core. The adhesive may be impregnated into the fabric prior to its placement on the core, or may be applied to the fabric by methods such as spraying, dipping, brushing, or powder coating. The shaft may be treated to make the exterior surface smooth after curing. A reinforced archery arrow shaft made by the method includes a tubular core and an attached fabric sleeve covering the core. The fabric is wrapped around and affixed to the core. The sleeve fabric may have a decorative design or pattern on the exterior surface thereof. Optionally, accessories may be attached to the arrow shaft to form an arrow.

24 Claims, 3 Drawing Sheets

U.S. PATENT DOCUMENTS 4,795,165 A 1/1989 Tehan
4,900,038 A 2/1990 Czetto et al.
5,035,764 A 7/1991 Blake
5,090,149 A 2/1992 Muk Kim
5,242,720 A 9/1993 Blake
5,295,692 A 3/1994 Wright
5,324,558 A 6/1994 Muto et al.
5,385,767 A 1/1995 Noguchi
5,397,636 A * 3/1995 Miyao et al. ..... 156/166
5,443,272 A 8/1995 Vicent, Sr.
5,496,027 A * 3/1996 Christian et al. ..... 473/561
5,538,769 A 7/1996 Sandman, Jr.
5,549,947 A 8/1996 Quigley et al.
5,686,155 A 11/1997 Suzue et al.
5,721,030 A 2/1998 Okada
5,763,035 A 6/1998 Andre De La Porte
5,842,942 A 12/1998 Doht et al.
5,904,803 A * 5/1999 Hillerich et al. ..... 156/494
5,964,056 A 10/1999 Grice
5,968,621 A 10/1999 Okada
5,997,970 A 12/1999 You
6,129,962 A 10/2000 Quigley et al.
6,139,451 A * 10/2000 Hillerich et al. ..... 473/564
6,179,736 B1 1/2001 Thurber
6,251,036 B1 6/2001 Wu et al.
6,276,401 B1 8/2001 Wilson
6,534,140 B2 3/2003 Hargette et al.
6,561,100 B1 5/2003 Buse et al.

* cited by examiner

METHOD OF MAKING ARROW SHAFT INCLUDING INTEGRAL SLEEVE, AND ARROW SHAFT WHICH IS PRODUCED THEREBY

This application is a continuation of U.S. Ser. No. 10/341,635 filed Jan. 14, 2003, now U.S. Pat. No. 6,866,599, which is a continuation of U.S. Ser. No. 09/685,233 filed Oct. 10, 2000, now U.S. Pat. No. 6,520,876.

BACKGROUND OF THE INVENTION

1. Field of the Invention

The present invention relates to methods of making archery arrow shafts, and to arrow shafts made by the method. More particularly, the present invention relates to methods of making reinforced arrow shafts, in which each arrow shaft includes a hollow tubular core and an integral fabric sleeve in covering relation thereon, and to products of the described methods. Even more particularly, the present invention relates to methods of making reinforced arrow shafts, in which each arrow shaft includes a hollow tubular core, a woven or non-woven fabric sleeve surrounding the core and integrally attached thereto, and an adhesive material impregnated into the sleeve, and to arrow shafts made by the described methods.

2. Description of the Background Art

Many different types of arrows are known for use in hunting and in sport archery. Many different arrows may be found in class 473, subclass 578, and the subclasses immediately following.

Examples of some of the issued patents disclosing archery arrows include U.S. Pat. Nos. 4,489,949, 4,533,146, 4,534,568, 4,795,165, and 4,900,038.

It has become fairly standardized for archery arrows to be made using a graphite or other carbon-containing material in the construction of the hollow arrow shaft. Tubular metal shafts have, alternatively, also been used.

However, there are some drawbacks with the use of carbon composite arrow shafts, including the tendency of some of the arrow shafts to become slightly warped during curing thereof, in the manufacturing process, leading to scrap.

Another limitation on conventional carbon composite arrow shafts is that, although they are adequate for normal usage, under heavy-duty use and in extreme conditions, such arrow shafts may fail.

Hunting arrows are placed under significant stresses during the placement of the arrows in bows, during release, and during the entry of the arrow into a target. If these types of stresses become more than the arrow shaft can withstand, carbon composite arrows may crack, break or splinter, thus necessitating the expense of purchasing replacement arrows.

Although such arrow failure is relatively uncommon and exceptional, improvements in arrow technology are always welcome. Experienced hunters and sportsmen often seek out premium quality products, which are the most reliable and durable available.

Another limitation of the known arrows is that, although it has been known to place a design or pattern on the exterior surface of arrow shafts, such as, e.g., a camouflage pattern, this is normally done using paint on the exterior surface of the arrow shaft, or, in the case of metal shafts, anodizing the metal in selected areas to create a pattern or design thereon. After repeated use, it is common for such paint or anodized material to be worn off, leading to deterioration of the arrow's appearance.

In the fishing art, which is a different technical area from archery, it has been known to place an external fabric sleeve on a fishing rod section, and to then cover the fabric sleeve with a transparent coating. U.S. Pat. No. 5,090,149 to Muk Kim discloses a hollow, decorated pole for a fishing rod, in which a flexible rectangular wrapper, with a predetermined design imprinted thereon, is positioned around the outer surface of the shaft, and is subsequently covered with a transparent coating.

While the fishing rod of Muk Kim is useful for fishermen and for the fishing industry, the teaching of this reference is not directed to any technical area outside of the fishing art.

Although the known devices have some utility for their intended purposes, a need still exists in the art for improved archery arrow shafts.

A need exists for an arrow shaft having a strengthened and reinforced tubular core.

A need also exists for decorated archery arrows, which carry an image or pattern thereon, in which the pattern is durable and long-lasting. Preferably, such an image or pattern could be integrally bonded to an arrow shaft. Ideally, such a decorated arrow would include a sleeve, to cover and coat an inner core, in order to provide added stability and strength to the arrow assembly.

SUMMARY OF THE INVENTION

The present invention provides an improved archery arrow shaft, including a tubular core, with a fabric sleeve attached to, covering and surrounding the core.

The sleeve may be formed from a rectangular piece of woven or non-woven fabric material, which has been wrapped around and affixed to the core.

Alternatively, the sleeve may be formed from a thin, continuous strip of fabric material, which is wrapped spirally and in covering relation around the arrow core.

In a preferred embodiment of the invention, the sleeve is formed from a patterned fabric, which has been imprinted with a decorative design or pattern on the exterior surface thereof.

The present invention also encompasses a method of making an arrow shaft having a fabric-reinforced core. In practicing the method according to the invention, first, a piece of woven or non-woven fabric material is placed in covering relation on a hollow tubular core, and is affixed thereto.

Then, in the method of the present invention, an adhesive on the fabric material is cured to adhere the fabric to the core. The adhesive may be impregnated into the fabric prior to its placement on the core, or alternatively, may be applied to the fabric by conventional methods such as spraying, dipping, brushing, or powder coating, after the fabric is applied to the core.

The adhesive may be applied as a liquid and air-dried, or alternatively, may be a thermosetting adhesive, which is cured by heating.

In a variation of the basic method, the fabric sleeve may be affixed to the core, by adhesive which is incorporated in the interstices of the fabric, when the adhesive is cured.

In a particularly preferred embodiment of the invention, the fabric material is pre-printed or otherwise inscribed with a design or pattern before being applied to the core.

Accordingly, it is an object of the present invention to provide a fabric-reinforced archery arrow shaft, and a method of producing such an arrow shaft.

It is another object of the present invention to provide a method of making a fiber-reinforced archery arrow shaft which is resistant to cracking, warping, splitting and/or breakage of a core thereof.

It is a further object of the present invention to provide a method of making an improved archery arrow shaft which bears a durable decoration, design or pattern thereon.

It is yet a further object of the invention to provide an arrow which includes a fabric-reinforced shaft.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION OF THE PREFERRED EMBODIMENTS

Figure 1:
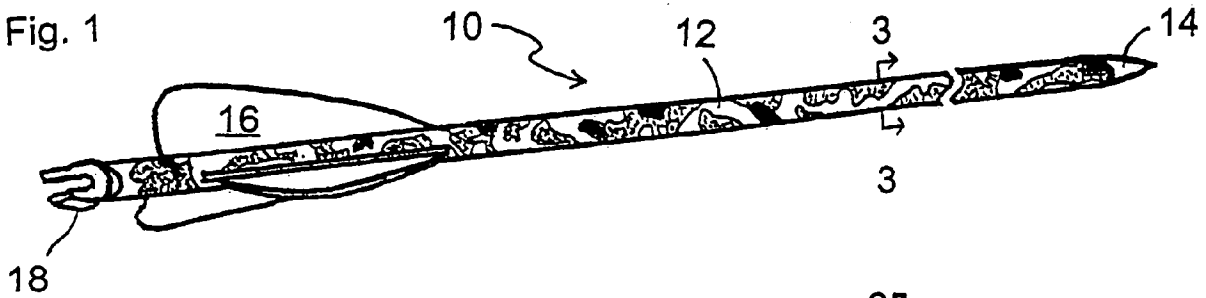
FIG. 1 is a perspective view of an archery arrow including a reinforced arrow shaft according to a preferred embodiment of the invention.
Figure 2:
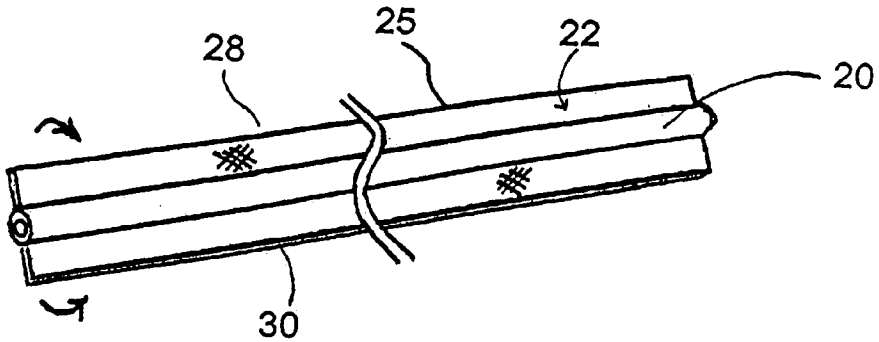
FIG. 2 is a perspective view of a the tubular core which is a component of the arrow shaft of FIG. 1, also showing a rectangular section of fabric material for forming a sleeve around the core in a first embodiment.
Figure 3:
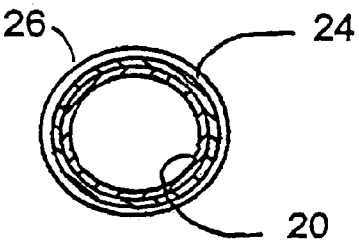
FIG. 3 is a cross-sectional view of the arrow shaft of FIG. 1, taken along the line 3—3 thereof.
Figure 4:
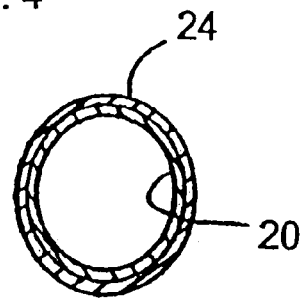
FIG. 4 is a cross-sectional view of an alternative version of the arrow shaft of FIG. 1, taken along the line 3—3 thereof.

Referring now to FIGS. 1–3 of the drawings, a reinforced arrow, according to a first embodiment of the invention, is shown generally at 10. The arrow 10 includes a reinforced arrow shaft 12, and a number of auxiliary accessories attached to the shaft, including a tip or arrow head 14, fletching 16, and a nock 18.

The shaft 12 includes a hollow tubular core 20, which can be made entirely out of a lightweight carbon composite material. Alternatively, the core 20 may be formed from fiberglass, from metal tubing such as aluminum or an aluminum alloy, or from a laminated combination of fiberglass and a carbon-based material. The core 20 may have a continuous diameter throughout. Alternatively, one end of the core 20 may have a larger diameter than the opposite end.

The shaft 12 is reinforced by first, wrapping a piece of fabric material 22 around the core 20 to form a sleeve 24 (FIG. 3, 4), and then curing an adhesive resin composition associated with the fabric material, to form a transparent coating 26 thereon.

In the embodiment of FIG. 2, the fabric material 22 is formed in the shape of a narrow rectangular sheet 25, which is oriented with its opposed side edges 28, 30 oriented parallel to the central longitudinal axis of the core 20, and the sheet is then wrapped closely around the core to form the sleeve 24. Where the sleeve 24 is formed in this way, the sheet 25 may be wrapped around the core 20 so that its opposed side edges 28, 30 abut and touch one another. Alternatively, the strip 25 may be wrapped around the core 20 so that a first side edge 28 covers and overlaps a second side edge 30.

Figure 5:
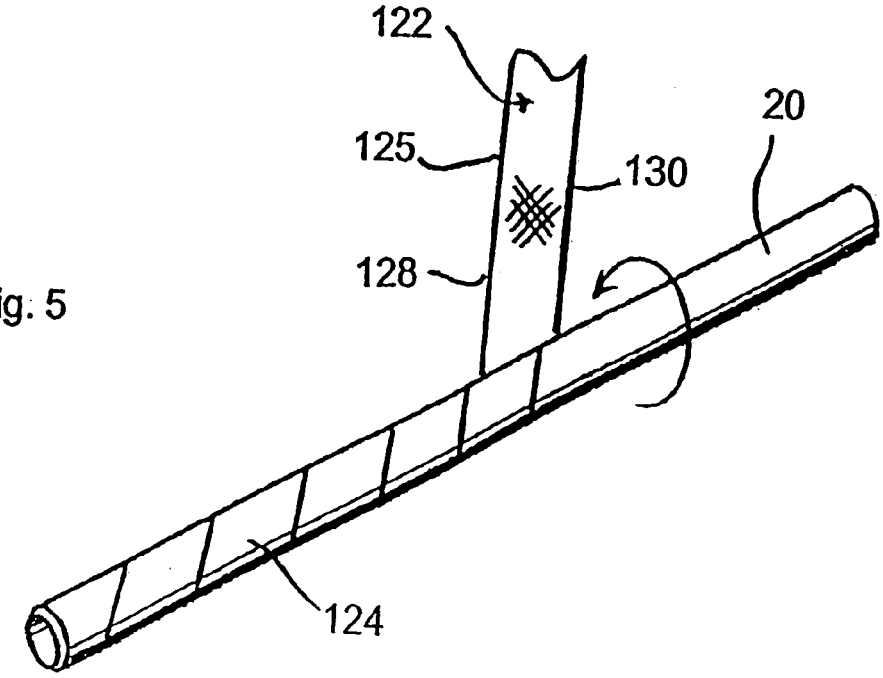
FIG. 5 is a perspective view of a tubular core which is a component of the arrow of FIG. 1, also showing a thin strip of fabric material for forming a sleeve around the core, the fabric material being wrapped spirally and in covering relation around the core in a second embodiment.

Alternatively, and as shown in FIG. 5, a sleeve 124 may be formed by wrapping a thin, elongated strip 125 of a fabric material 122 in spiral fashion around the core 20. Where the sleeve 124 is formed in this way, the strip 125 may be wrapped around the core 20 so that its opposed side edges 128, 130 abut and touch one another. Alternatively, the strip 122 may be wrapped around the core 20 so that a first side edge 128 covers and overlaps a second side edge 130.

The fabric material 22 may be a woven or a nonwoven fabric. Knit fabrics are considered to be woven fabrics in the practice of the invention.

The material of the fabric may be selected from the group consisting of nylon, polyester, cotton, KEVLAR™, or other material known in the art.

In one embodiment of the invention, the sleeve is formed from a patterned fabric, which has been imprinted or otherwise inscribed with a decorative design or pattern on the exterior surface thereof. In the embodiment of FIG. 1, a camouflage pattern is shown on the sleeve 24.

The adhesive or protective composition may be applied to the exterior of the fabric sleeve 24 to form a transparent protective outer layer 26, as shown in FIG. 3.

Alternatively, the adhesive or protective composition may be impregnated into the interstices of the fabric material 22, 122 so that the adhesive is distributed through the sleeve 24. In one embodiment, the adhesive in the fabric 22, 122 bonds the fabric to the core 20 when the adhesive is cured.

By way of example and not limitation, dipping the fabric into a liquid solution, suspension or emulsion of uncured adhesive is one way of distributing the adhesive into the interstices of the fabric. Alternatively, this may be accomplished by spraying a liquid under pressure into the fabric, where the liquid contains uncured adhesive.

Figure 6:
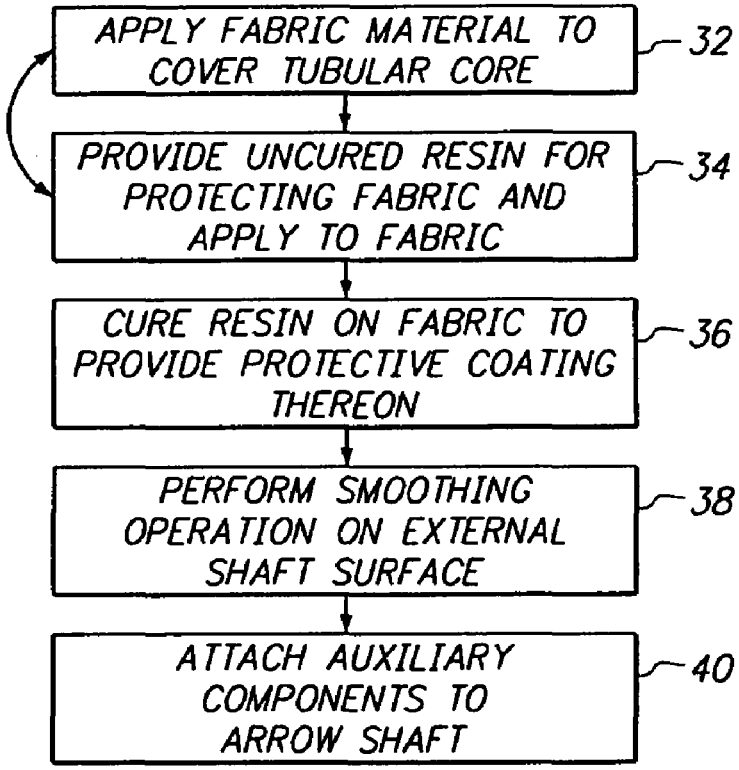
FIG. 6 is a graphical flow chart showing a sequence of steps in a preferred method according to the invention.

The present invention also encompasses a method of making a fabric-reinforced arrow shaft 12. In practicing the method according to the invention, a piece of woven or non-woven fabric material 22 is placed in covering relation on a hollow tubular core 20, and is affixed thereto. This method step is shown at 32 in FIG. 6.

As previously noted, in a particularly preferred embodiment of the invention, the fabric material 22, 122 is preprinted or otherwise inscribed with a design or pattern before being applied to the core 20. This also applies to the method hereof.

Another step in the method is to provide an uncured adhesive for protecting the fabric, and to apply it to the fabric material 22. This step is shown at 34 in FIG. 6, and as shown by the two-headed arrow in FIG. 6, these first two steps may be performed in any order. It is preferred that the adhesive is applied to the fabric before the fabric is wrapped around the core.

As used herein, the term "adhesive" includes, but is not exclusively limited to, urethanes, varnishes, lacquers, epoxies, paints, and powder coatings The adhesive may be impregnated into the fabric 22, 122, before the fabric is placed on the core 20, or alternatively, the adhesive may be applied to the sleeve 24 after it is wrapped around the core.

Where appropriate, the adhesive may be applied to the fabric by any conventional method, such as spraying, dipping, brushing, or powder coating, after the fabric is applied to the core 20.

Then, in the method of the present invention, the adhesive on the fabric material 22, 122 is cured, to adhere the fabric to the core. This curing step is shown at 36 in FIG. 6. In the curing step, the adhesive may be applied as a liquid and air-dried, or alternatively, may be a thermosetting adhesive, which is cured by heating. This curing of the adhesive completes the required steps, and produces a usable reinforced arrow shaft.

While not wishing to be bound by any theory, it is believed that the adhesive material has a tendency to strengthen, reinforce, and protect the fabric material of the sleeve.

Following the curing step, optionally, the shaft 12 may be treated to perform a smoothing operation on the external surface thereof. This may be done by hand or by an appropriate machine. Most preferably, the smoothing operation is performed by placing the cured shaft 12 in a centerless grinder, and grinding the external surface until it is smooth. This smoothing step is shown at 38 in FIG. 6.

An extra step which may be performed in the method according to the invention, which may be optionally performed subsequent to the curing step, but which is not required, is attaching one or more auxiliary accessories to the cured shaft 12. These accessories may include a tip or arrow head 14, fletching 16, and a nock 18.

Although the present invention has been described herein with respect to a preferred embodiment thereof, the foregoing description is intended to be illustrative, and not restrictive. Those skilled in the art will realize that many modifications of the preferred embodiment could be made which would be operable. All such modifications which are within the scope of the claims are intended to be within the scope and spirit of the present invention.

Having, thus, described the invention, what is claimed is:

1. A method of making a fabric-reinforced arrow shaft, comprising the steps of:

a) surrounding a hollow tubular core with a fabric material to form a sleeve thereon, said sleeve closely conforming to an exterior surface of the core, wherein said core comprises carbon;

b) curing an adhesive operatively associated with the fabric material to affix the sleeve to the core, whereby the coated core forms an arrow shaft.

2. The method of claim 1, further comprising a step of c) attaching at least one auxiliary component selected from the group consisting of arrow heads, fletching and nocks to the shaft.

3. The method of claim 1, further comprising the step of machining an exterior surface of the coated shaft, after the adhesive curing step, to create a smooth surface thereon.

4. The method of claim 1, wherein the fabric is a woven material.

5. The method of claim 1, wherein the fabric is a non-woven material.

6. The method of claim 1, wherein the fabric sleeve has a decoration or pattern on an exterior surface thereof.

7. The method of claim 1, wherein the curable adhesive material is selected from the group consisting of urethanes, varnishes, lacquers, epoxies, paints, and powder coatings.

8. A method of making a fabric-reinforced arrow shaft, comprising the steps of:

a) surrounding a hollow tubular core with a fabric material to form a sleeve thereon, said sleeve closely conforming to an exterior surface of the core, wherein said core comprises carbon;

b) curing an adhesive operatively associated with the fabric material to affix the sleeve to the core, whereby the coated core forms an arrow shaft, and c) attaching at least one auxiliary component selected from the group consisting of arrow heads, fletching and nocks to the shaft.

9. The method of claim 8, further comprising a step of machining an exterior surface of the coated shaft, after the adhesive curing step, to create a smooth surface thereon.

10. The method of claim 8, wherein the fabric is a woven material.

11. The method of claim 8, wherein the fabric is a non-woven material.

12. The method of claim 8, wherein the fabric sleeve has a decoration or pattern on an exterior surface thereof.

13. The method of claim 8, wherein the curable adhesive material is selected from the group consisting of urethanes, varnishes, lacquers, epoxies, paints, and powder coatings.

14. The method of claim 8, further comprising a step of machining the shaft in a centerless grinder to perform a smoothing operation on the external surface thereof.

15. A method of making a fabric-reinforced arrow shaft, comprising the steps of:

a) surrounding a hollow tubular core with a fabric material to form a sleeve thereon, said sleeve closely conforming to an exterior surface of the core, wherein said core comprises carbon;

b) curing an adhesive operatively associated with the fabric material to affix the sleeve to the core, whereby the coated core forms an arrow shaft, and c) machining an exterior surface of the coated shaft, after the adhesive curing step, to create a smooth surface thereon.

16. The method of claim 15, wherein the fabric is a woven material.

17. The method of claim 15, wherein the fabric is a non-woven material.

18. The method of claim 15, wherein the fabric sleeve has a decoration or pattern on an exterior surface thereof.

19. The method of claim 15, wherein the curable adhesive material is selected from the group consisting of urethanes, varnishes, lacquers, epoxies, paints, and powder coatings.

20. The method of claim 15, further comprising a step of e) attaching at least one auxiliary component selected from the group consisting of arrow heads, fletching and nocks to the shaft.

21. The method of claim 15, wherein the machining step is performed in a centerless grinder.

22. The method of claim 15, wherein the fabric is substantially rectangular in shape.

23. The method of claim 22, wherein the fabric is placed on the core with opposed side edges thereof in abutting relation.

24. The method of claim 22, wherein the fabric is placed on the core with opposed side edges thereof overlapping one another.

* * * * *

UNITED STATES PATENT AND TRADEMARK OFFICE

CERTIFICATE OF CORRECTION

PATENT NO. : 7,201,818 B2
APPLICATION NO. : 10/701896
DATED : April 10, 2007
INVENTOR(S) : Eastman It is certified that error appears in the above-identified patent and that said Letters Patent is hereby corrected as shown below:

Column 5:
Line 44, change "comprising a step of c)" to --comprising a step of:--.
Line 45, change "attaching at least" to -- c) attaching at least--.

Column 6:
Line 49, change "e) attaching at least one" to --d) attaching at least one--.

Signed and Sealed this

Seventh Day of August, 2007

JON W. DUDAS
*Director of the United States Patent and Trademark Office*